US007245838B2

(12) United States Patent
Swift

(10) Patent No.: US 7,245,838 B2
(45) Date of Patent: Jul. 17, 2007

(54) PRINTING PLATFORM

(75) Inventor: Joseph A. Swift, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/156,778

(22) Filed: Jun. 20, 2005

(65) Prior Publication Data

US 2006/0285857 A1 Dec. 21, 2006

(51) Int. Cl.
*G03G 15/00* (2006.01)

(52) U.S. Cl. ..... 399/8; 399/9; 399/110

(58) Field of Classification Search ..... 399/8, 399/9

See application file for complete search history.

(56) References Cited

U.S. PATENT DOCUMENTS 4,240,346 A * 12/1980 Landis et al. ..... 101/139
4,579,446 A 4/1986 Fujino et al.
4,587,532 A 5/1986 Asano
4,836,119 A 6/1989 Siraco et al.
5,004,222 A 4/1991 Dobashi
5,080,340 A 1/1992 Hacknauer et al.
5,095,342 A 3/1992 Farrell et al.
5,159,395 A 10/1992 Farrell et al.
5,208,640 A 5/1993 Horie et al.
5,272,511 A 12/1993 Conrad et al.
5,326,093 A 7/1994 Sollitt
5,435,544 A 7/1995 Mandel
5,473,419 A 12/1995 Russel et al.
5,489,969 A 2/1996 Soler et al.
5,504,568 A 4/1996 Saraswat et al.
5,525,031 A 6/1996 Fox
5,557,367 A 9/1996 Yang et al.
5,568,246 A 10/1996 Keller et al.
5,570,172 A 10/1996 Acquaviva
5,596,416 A 1/1997 Barry et al.
5,629,762 A 5/1997 Mahoney et al.
5,636,008 A * 6/1997 LoBiondo et al. ..... 399/8
5,710,968 A 1/1998 Clark et al.
5,778,377 A 7/1998 Marlin et al.
5,884,910 A 3/1999 Mandel
5,960,228 A * 9/1999 Budnik et al. ..... 399/8
5,995,721 A 11/1999 Rourke et al.

(Continued)

FOREIGN PATENT DOCUMENTS

JP 62069277 A * 3/1987

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—David M. Gray
*Assistant Examiner*—Bryan Ready
(74) *Attorney, Agent, or Firm*—Eugene O. Palazzo; Fay Sharpe LLP

(57) ABSTRACT

Described herein is a printing platform having one or more marking modules for reproducing an image on a substrate; a print media source processing unit that supplies the substrate; a finisher that provides finishing capabilities for the substrate; and a platform manager that automatically removes electrical power from at least one component of the printing platform while other components continue to process print jobs.

20 Claims, 3 Drawing Sheets

U.S. PATENT DOCUMENTS

| | | | | |
|---|---|---|---|---|
| 6,059,284 | A | 5/2000 | Wolf et al. | |
| 6,125,248 | A | 9/2000 | Moser | |
| 6,241,242 | B1 | 6/2001 | Munro | |
| 6,297,886 | B1 | 10/2001 | Cornell | |
| 6,341,773 | B1 | 1/2002 | Aprato et al. | |
| 6,384,918 | B1 | 5/2002 | Hubble, III et al. | |
| 6,450,711 | B1 | 9/2002 | Conrow | |
| 6,476,376 | B1 | 11/2002 | Biegelsen et al. | |
| 6,476,923 | B1 | 11/2002 | Cornell | |
| 6,487,375 | B2 * | 11/2002 | Ferrer et al. | 399/8 |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,819,906 | B1 | 11/2004 | Herrmann et al. | |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |
| 2005/0031368 | A1 * | 2/2005 | Han et al. | 399/88 |

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel, et al.
U.S. Appl. No. 10/785,211, filed Feb. 24, 2004, Lofthus, et al.
U.S. Appl. No. 10/881,619, filed Jun. 30, 2004, Bobrow.
U.S. Appl. No. 10/917,676, filed Aug. 13, 2004, Lofthus, et al.
U.S. Appl. No. 10/917,768, filed Aug. 13, 2004, Lofthus, et al.
U.S. Appl. No. 10/924,106, filed Aug. 23, 2004, Lofthus, et al.
U.S. Appl. No. 10/924,113, filed Aug. 23, 2004, deJong, et al.
U.S. Appl. No. 10/924,458, filed Aug. 23, 2004, Lofthus, et al.
U.S. Appl. No. 10/924,459, filed Aug. 23, 2004, Mandel, et al.
U.S. Appl. No. 10/933,556, filed Sep. 3, 2004, Spencer, et al.
U.S. Appl. No. 10/953,953, filed Sep. 29, 2004, Radulski, et al.
U.S. Appl. No. 10/999,326, filed Nov. 30, 2004, Grace, et al.
U.S. Appl. No. 10/999,450, filed Nov. 30, 2004, Lofthus, et al.
U.S. Appl. No. 11/000,158, filed Nov. 30, 2004, Roof.
U.S. Appl. No. 11/000,168, filed Nov. 30, 2004, Biegelsen, et al.
U.S. Appl. No. 11/000,258, filed Nov. 30, 2004, Roof.
U.S. Appl. No. 11/001,890, filed Dec. 2, 2004, Lofthus, et al.
U.S. Appl. No. 11/002,528, filed Dec. 2, 2004, Lofthus, et al.
U.S. Appl. No. 11/051,817, filed Feb. 4, 2005, Moore, et al.
U.S. Appl. No. 11/070,681, filed Mar. 2, 2005, Viturro, et al.
U.S. Appl. No. 11/081,473, filed Mar. 16, 2005, Moore.
U.S. Appl. No. 11/069,020, filed Feb. 28, 2005, Lofthus, et al.
U.S. Appl. No. 11/089,854, filed Mar. 25, 2005, Clark, et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore, et al.
U.S. Appl. No. 11/094,998, filed Mar. 31, 2005, Moore, et al.
U.S. Appl. No. 11/094,864, filed Mar. 31, 2005, de Jong, et al.
U.S. Appl. No. 11/095,872, filed Mar. 31, 2005, Julien, et al.
U.S. Appl. No. 11/102,355, filed Apr. 8, 2005, Fromherz, et al.
U.S. Appl. No. 11/084,280, filed Mar. 18, 2005, Mizes.
U.S. Appl. No. 11/109,566, filed Apr. 19, 2005, Mandel, et al.
U.S. Appl. No. 11/109,558, filed Apr. 19, 2005, Furst, et al.
U.S. Appl. No. 11/109,996, filed Apr. 20, 2005, Mongeon, et al.
U.S. Appl. No. 11/093,229, filed Mar. 29, 2005, Julien.
U.S. Appl. No. 11/102,899, filed Apr. 8, 2005, Crawford, et al.
U.S. Appl. No. 11/102,910, filed Apr. 8, 2005, Crawford, et al.
U.S. Appl. No. 11/115,766, filed Apr. 27, 2005, Grace.
U.S. Appl. No. 11/102,332, filed Apr. 8, 2005, Hindi, et al.
U.S. Appl. No. 11/136,959, filed May 25, 2005, German, et al.
U.S. Appl. No. 11/136,821, filed May 25, 2005, Robinson.
U.S. Appl. No. 11/122,420, filed May 5, 2005, Richards.
U.S. Appl. No. 11/137,634, filed May 25, 2005, Lofthus, et al.
U.S. Appl. No. 11/137,251, filed May 25, 2005, Lofthus, et al.
U.S. Appl. No. 11/137,273, filed May 25, 2005, Anderson, et al.

* cited by examiner

PRINTING PLATFORM

BACKGROUND

The following relates to printing systems. It finds particular application to automatically de-energizing selective portions of a multi-print (electrophotographic and xerographic or ink jet) engine printing platform while providing other portions of the platform with power to process print jobs.

In a typical xerographic system, such as a copying or printing device, an electronic image is transferred to a print medium, such as paper, plastic, velum and the like. In a xerophotographic process, a photoconductive insulating member is charged to a uniform potential and exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with developing powder referred to in the art as toner. This image may be transferred to a support surface, such as paper, to which the toner image is permanently affixed in a fusing process.

In a multicolor electrophotographic process, successive latent images corresponding to different colors are formed on the insulating member and developed with a respective toner. Each single color toner image is transferred to the paper sheet in superimposed registration with the prior toner image. For simplex printing, only one side of a sheet is printed, while for duplex printing, both sides are printed. Other printing processes are known in which the electronic signal is reproduced as an image on a sheet by other means, such as through impact (e.g., a type system or a wire dot system), or through use of a thermosensitive system, ink jets, laser beams, or the like.

To meet demands for higher outputs of printed pages, one approach has been to increase the speed of the printer, which places greater demands on each of the components of the printer. Another approach has been to develop printing systems which employ several marking engines. The multiple marking engine systems enable high overall outputs to be achieved by printing portions of the same document on multiple printers. Such systems are commonly referred to as "tandem engine" printers, "parallel" printers, or "cluster printing," in which an electronic print job may be split up for distributed higher productivity printing by different printers, such as separate printing of the color and monochrome pages. Such a system feeds paper from a common source to a plurality of printers, which may be horizontally and/or vertically stacked. Printed media from the various printers is then moved from the printers to a finisher where the sheets associated with a single print job are assembled.

In some multi-marking engine systems, print jobs associated with an inoperable printer are re-routed to an operating printer in order to maintain continuous operation as described in U.S. Pat. No. 5,150,167, "Image Forming Apparatus," Gonda, et al. However, Gonda, et al. simply checks whether a printer is able to continue an on-going printing process, and if it is not due to lack of paper, empty toner, etc., the printing process is routed to another printer to provide continuous printing.

During scheduled and/or emergency service for conventional printers, copiers and/or multifunction devices, electrical power is removed or limited to the printers for safety reasons. For example, power is removed from a marking engine being replaced by a service technician to mitigate electrical shock. Typically, removing or limiting power to a conventional printer, copier or multifunction device disables its printing capabilities. For instance, in a system with twenty marking engines modules, a single malfunctioning component (e.g., software and/or hardware) may result in power removal from the entire printing system until the component is fixed or replaced. During periods of down time, print jobs are delayed, which results in customer annoyance, decreased customer utility, and loss in revenue. This problem is exacerbated when considered in light of a population of printing platforms.

CROSS REFERENCE TO RELATED PATENTS AND APPLICATIONS

The following applications, the disclosures of each being totally incorporated herein by reference are mentioned:

U.S. application Ser. No. 10/924,458, filed Aug. 23, 2004, entitled "PRINT SEQUENCE SCHEDULING FOR RELIABILITY," by Robert M. Lofthus, et al.;

U.S. application Ser. No. 11/069,020, filed Feb. 28, 2004, entitled "PRINTING SYSTEMS," by Robert M. Lofthus, et al.;

U.S. application Ser. No. 11/102,899, filed Apr. 8, 2005, entitled "SYNCHRONIZATION IN A DISTRIBUTED SYSTEM," by Lara S. Crawford, et al.;

U.S. application Ser. No. 11/102,910, filed Apr. 8, 2005, entitled "COORDINATION IN A DISTRIBUTED SYSTEM," by Lara S. Crawford, et al.;

U.S. application Ser. No. 11/102,355, filed Apr. 8, 2005, entitled "COMMUNICATION IN A DISTRIBUTED SYSTEM," by Markus P. J. Fromherz, et al.;

U.S. application Ser. No. 11/102,332, filed Apr. 8, 2005, entitled "ON-THE-FLY STATE SYNCHRONIZATION IN A DISTRIBUTED SYSTEM," by Haitham A. Hindi;

U.S. application Ser. No. 11/122,420, filed May 5, 2005, entitled "PRINTING SYSTEM AND SCHEDULING METHOD," by Austin L. Richards;

U.S. application Ser. No. 11/136,821, filed May 25, 2005, entitled "AUTOMATED PROMOTION OF MONOCHROME JOBS FOR HLC PRODUCTION PRINTERS," by David C. Robinson;

U.S. application Ser. No. 11/136,959, filed May 25, 2005, entitled "PRINTING SYSTEMS", by Kristine A. German et al.;

U.S. application Ser. No. 11/137,634, filed May 25, 2005, entitled "PRINTING SYSTEM", by Robert M. Lofthus et al.; and U.S. application Ser. No. 11/137,251, filed May 25, 2005, entitled "SCHEDULING SYSTEM", by Robert M. Lofthus et al.

BRIEF DESCRIPTION

According to an aspect illustrated herein, a printing platform has one or more marking modules for reproducing an image on a substrate; a print media source processing unit that supplies the substrate; a finisher that provides finishing capabilities for the substrate; and a platform manager that automatically removes electrical power and optionally mechanical power from at least one component of the printing platform while other components continue to process print jobs.

DETAILED DESCRIPTION

Figure 1:
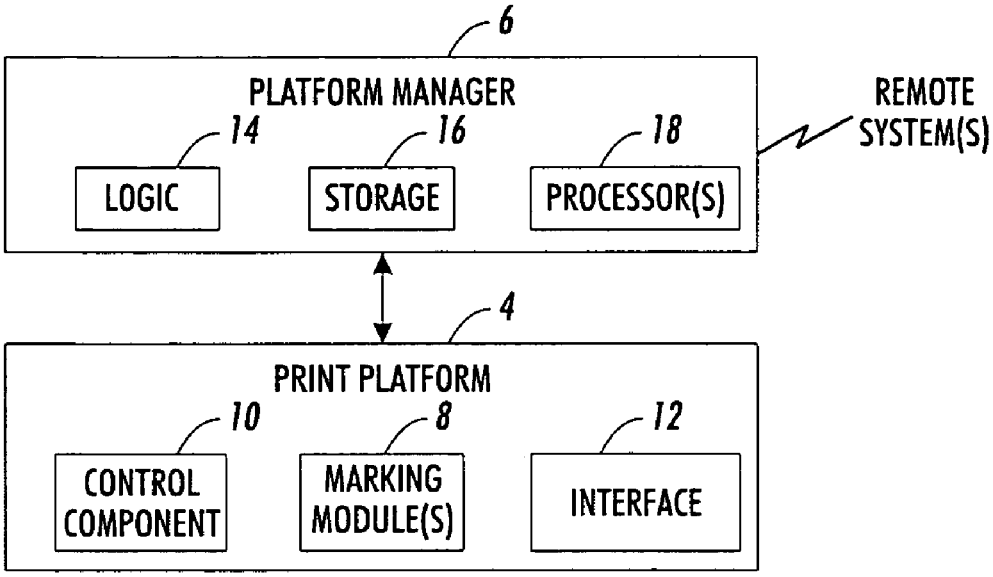
FIG. 1 illustrates a printing architecture that uses a platform manager to selectively de-energize regions of a printing platform.

With reference to FIG. 1, an "always on" printing architecture ("architecture") is illustrated. The architecture includes a printing platform 4 and a platform manager 6 that facilitates managing various components of the printing platform 4, including selectively providing and removing electrical power to the various components of the printing platform 4 such that portions of the printing platform 4 can be de-energized while other portions of the printing platform 4 are energized to process print jobs.

The printing platform 4 includes one or more marking modules 8. The marking modules 8 can be stacked vertically and/or horizontally to form a tandem, parallel and/or cluster printer for simplex, duplex and/or multi-pass printing. Each of the marking modules 8 includes at least one marking engine (not shown). Suitable marking engines include electrophotographic printers, ink-jet printers, including solid ink printers, thermal head printers that are used in conjunction with heat sensitive paper, and/or other devices capable of marking an image on a substrate. The marking engines may be of the same or different modalities (e.g., black (K), custom color (C), process color (P), or magnetic ink character recognition (MICR) (M)). In addition, the marking engines may be capable of generating more than one type of print modality, for example, black and process color.

A control component 10 controls the printing platform 4. For example, the control component 10 invokes warm up routines when power is cycled on or when the printing platform 4 transitions from a lower power (or sleep) mode to an active mode. In another example, the control component 10 loads software, firmware, applications and the like. In yet another example, the control component 10 pauses print jobs when printing problems occur and provides notifications that a problem exists. Such notifications can be through audible and/or visual indicators located on the printing platform 4. In still another example, the control component 10 initiates print jobs upon receiving print instructions from a user. It is to be appreciated that the foregoing examples are for explanatory purposes, and that the control component 10 can control more, less, similar and/or different operations of the printing platform 4.

The control component 10 communicates with the user through a user interface 12. The user interface 12 can display one or more menus of options for user selection, error codes, warning messages, print job status, etc. The user interacts with the user interface 12 through various input devices such as a touch-screen, a mouse, a digital pen, a keyboard, computer, and the like. The user employs such input devices to navigate through menus, select options, configure the printing platform 4, activate a particular function in connection with a multi-functional platform (e.g., print, copy, scan . . . ), retrieve messages, etc. By way of example, a user desiring to produce several copies of a document can interact with the user interface 12 to activate a copy menu, input a number of copies, define paper type (e.g., letter, A4 . . . ), set image quality (e.g., resolution) and color (e.g., grey scale, color . . . ), etc. The user can then provide the original to the print platform 4, which produces the copies based on the user input.

In this example, the platform manager 6 resides external to the printing platform 4. As depicted, the platform manager 6 is associated with logic 14, storage 16, and one or more processors 18, which enable the platform manager 6 to perform computations, execute instructions, store data, etc. Communication between the platform manager 6 and the printing platform 4 is through a wire and/or wireless network (e.g., Bluetooth, infrared, Ethernet . . . ), a bus (e.g., backplane), a port (e.g., parallel, serial . . . ), or the like. In other instances, the platform manager 6 is located within the printing platform 4, for example, as executing software and/or dedicated component (e.g., software, hardware, firmware . . . ). When residing internal to the printing platform 4, the platform manager 6 can use the logic 14, the storage 16, and the one or more processors 18 and/or logic, storage and processors associated with the printing platform 4.

As noted previously, the platform manager 6 facilitates managing the printing platform 4. Such management includes, but is not limited to, selectively energizing and/or de-energizing portions of the printing platform 4. By way of example, a user or service technician can interact with the platform manager 6 (e.g., through the user interface 12, a port on the platform manager 6, remotely, a network . . . ) to activate diagnostic, troubleshooting, testing, etc: utilities. The user can employ such utilities to interrogate the components (e.g., marking engines, transfer belts, paper highways . . . ) of the printing platform 4 to determine whether any components should be serviced (e.g., corrective and preventative maintenance). The interrogation can include reading data from numeric, alpha-numeric, digital, and/or analog sensors and/or related data files and can include other sources such as dip switches, registers, memory, etc. Such interrogation can be achieved manually through interaction between the platform manager 6 and the user or automatically by the platform manager 6. Alternatively, the user can interrogate the printing platform 4 via service tools (e.g., laptop with diagnostic software, instruments for measuring electrical characteristics, visual inspection . . . ) and provide the platform manager 6 with relevant information.

The platform manager 6 validates, interprets, and analyzes the results of the interrogation. The platform manager 6 utilizes established protocols (e.g., via look up tables) to determine which components (e.g., regions of the printing platform 4) to de-energize, the order in which energy should be removed form the components, etc. based on the service to be performed. In addition, the platform manager 6 reroutes, pauses, and/or cancels print jobs associated with these components. As noted above, these components can be malfunctioning or functioning components identified for preventive maintenance. Upon determining the components, order, etc., the platform manager 6 removes power (e.g., by transmitting power removal instructions to the control component 10) and energy is removed from the components. Alternatively, the platform manager 6 may interrogate the state of power transmittal to the component to verify that it is de-energized and in a safe state to initiate the repair sequence. The control component 10 can then deactivate menus associated with the disabled components to prevent a user from attempting to employ the de-activated region of the printing platform 4. In addition, the control component 10 can display messages (e.g., via the user interface 12) and/or provide audible warnings to apprise the user of the disabled region. The platform manger 6 can de-energize a variety of power types including, but not limited to: electrical power, mechanical power, pneumatic and air flow including ventilation for cooling or heating, vacuum or other exhaust process, and the like. It may also interrupt the flow of chemicals and other materials in the form of solids, gases or liquids to the components. Examples of which are toner, fuser oil, ink, and the like. Optionally, it may enable access to the region of the print platform 4 containing the component by, for example, unlocking cover panels, deactivating interlocks, automatically transporting subsystems into an easy to access area outside of the covers, and the like, disengaging electrical and mechanical interconnects, and the like.

The platform manager 6 can also transmit the interrogation results, analysis, and/or associated information to other entities. For instance, such data can be conveyed to a central command center where it is used to order parts, adjust inventory, notify a service technician to re-stock the part at the customer location, etc. In another example, the data can be provided to a database and used for historical purposes, evaluating the cost and downtime, generating statistics, etc.

The printing platform 4 can be partitioned such that one or more marking modules 8 and associated components (e.g., media feeder and output tray) are virtually independent of other marking modules 8. The platform manager 6 leverages such partitioning to power down and isolate regions of the printing platform 4. For example, the protocols used to determine which components to de-energize can also identify regions where energy should be removed. This allows service personnel to repair (e.g., replace parts, test . . . ) one or more components within a region while the other portions of the printing platform 4 process jobs. Thus, one or more marking modules 8 can be powered down, wherein other marking modules 8 are powered and used to process print jobs.

Optionally, interlocks and other known safety devices can be integrated within the printing platform 4. The interlocks can be configured to be region specific and located in connection with external and/or internal covers. For example, a closed loop circuit with relays that engage/disengage upon closing/opening covers can also be used to control power. When at least one relay is tripped, power can be removed from all components within a region. Such techniques provide fail-safe provisions and mitigate single point failures that can lead to injury to service personnel, the user and/or the printing platform 4. In addition, internal covers can facilitate isolating service personnel from energized components associated with energized regions and other foreign objects of the printing platform 4.

Figure 2:
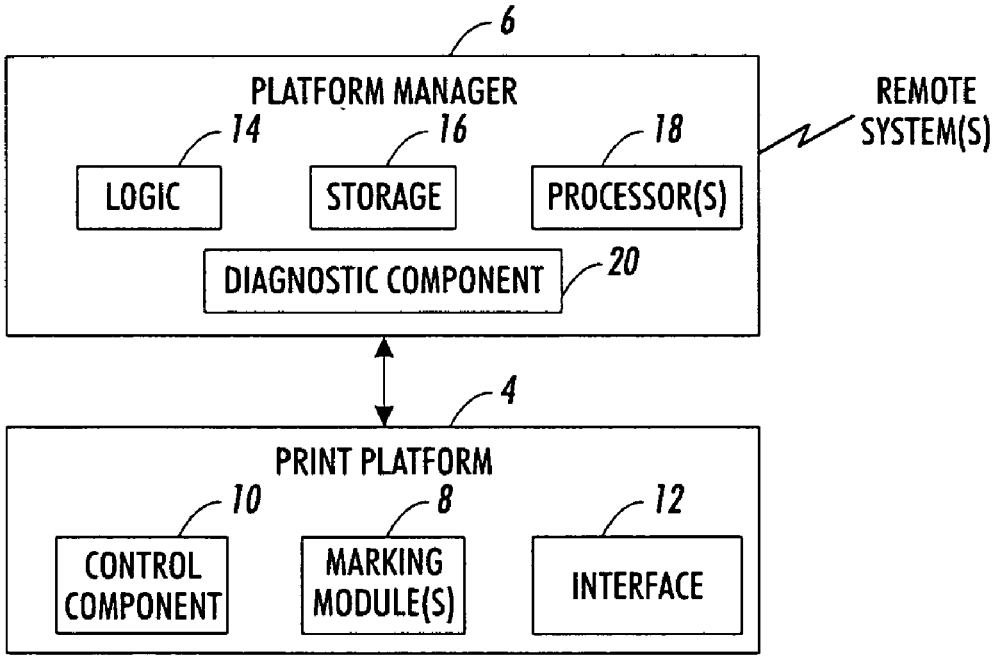
FIG. 2 illustrates a printing architecture that employs self-diagnostics to determine regions of a printing platform to de-energize.

With reference to FIG. 2, the architecture further includes a diagnostic component 20. The platform manager 6 can invoke the diagnostic component 20 to perform self-diagnostics of the printing platform 4. Thus, in addition to user/service initiated diagnostics, the architecture provides for periodic (e.g., determined by the user, service . . . ) automated self-diagnostics.

The diagnostics component 20 can determine whether any components therein have failed and/or the overall health of components such as marking engines, drives, motors, etc. Component health can be determined through operating characteristics such as current, voltage, impedance, inductance, capacitance, temperature, mass, force, size, etc. These characteristics typically are specified by a manufacturer or vendor and can be obtained through sensors (e.g., a temperature sensor located proximate a marking engine) and/or features associated with the components (e.g., a motor may utilize electrical current feedback to control velocity). Upon obtaining such characteristics, the platform manager 6 analyzes them in light of predetermined acceptable values. The results of the analysis provide an indication of the health of individual components.

These characteristics can also be used to generate trends, which may illustrate degradation of a component over time. For example, failing bearings in a motor (e.g., associated with a paper highway) may cause the motor to draw more current to compensate for increased friction. During early stages of failure, the increased current draw may increase, but remain within the acceptable current draw range. As the bearings continue to degrade (and possible freeze up due to lack of lubrication), current draw increases and eventually falls outside of the acceptable range. Such trend can be captured and used during subsequent analyses to determine whether a component is entering or is within its end of expected life phase or is likely to be in the process of failing. This information allows the platform manager 6 to request service (and possible corrective maintenance) prior to failure. Such information can also be used to order parts prior to component failure.

The diagnostics component 20 can be used in connection with manual diagnostics and testing described above in connection with FIG. 1. Thus, service personnel can perform troubleshooting and test procedures and provide the results to the platform manager 6 (e.g., through the user interface 12, over a wire or wireless connection . . . ). Such interrogation can include reading values from registers, measuring values at test points, recording codes on visual displays, etc. In addition, the diagnostics component 20 can facilitate manual troubleshooting and testing by instructing service personnel regarding appropriate tests and/or test steps. The diagnostic component 20 can also receive data from sensors positioned within the printing platform 4. For example, imaging sensors can be positioned proximate a transfer belt or drum or in connection with a path extending from a marking module. The imaging sensors can be used to collect information indicative of the print quality and provide such information to the platform manager 6. For instance, the imaging sensors can capture data that can be analyzed to detect streaks, spots, color gamut, glossiness, etc.

Figure 3:
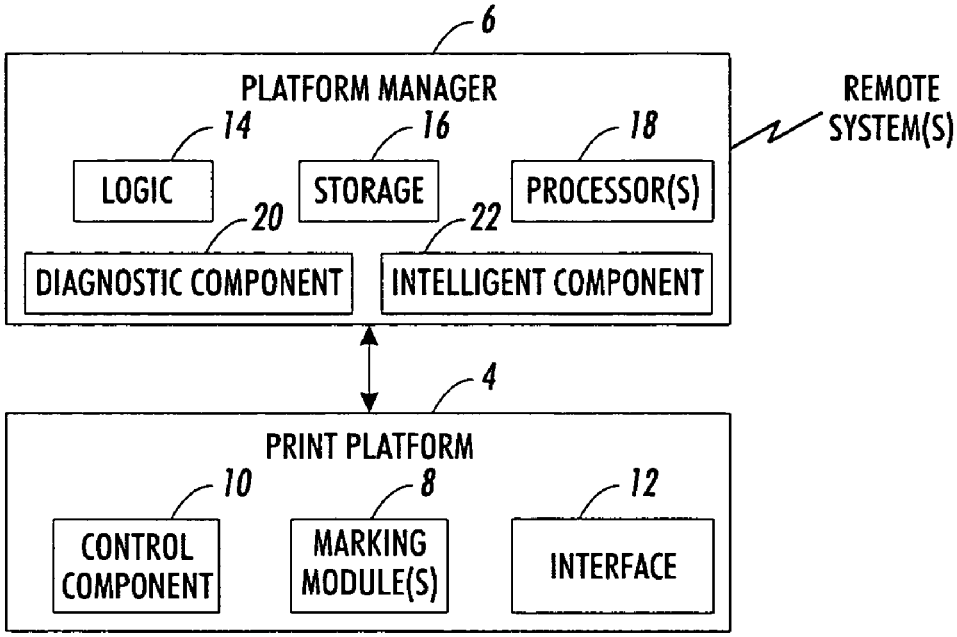
FIG. 3 illustrates a printing architecture that employs intelligence to determine regions of a printing platform to de-energize.

With reference to FIG. 3, the architecture further includes an intelligent component 22 that employs various machine learning techniques, algorithms, approaches, etc. to facilitate identifying failed components, portions of the printing platform 4 to power down, suitable service protocols to deploy, etc. For example, the intelligent component 22 can employ a machine learning algorithm that can reason about or infer from diagnostics, test results, user and job histories, trends, observations, features, characteristics, and/or properties. In addition, the intelligent component 22 can evaluate various run options against knowledge of the upcoming print jobs and therefrom determine how the printing platform 4 can continue functioning during service. Upon that determination, limited operability can continue in an automated manner (e.g., by pre-entered default settings) or, via the user interface 12, can communicate status and await further commands. The intelligence component 22 can further analyze the information to determine whether remaining portions of the printing platform 4 can continue to operate safely. As an example, upon determining a particular marking engine should be replaced, the intelligent component 22 may determine that it is safe to maintain power to a particular row of marking engines and the entire paper path during swapping out a component.

Various classification (explicitly and/or implicitly trained classifiers) schemes and/or systems (e.g., support vector machines, neural networks, expert systems, Bayesian belief networks, fuzzy logic, data fusion engines . . . ) are employed by the intelligent component 22. Such classification can employ a probabilistic and/or statistical-based analysis (e.g., factoring into the analysis utilities and costs) to automatically make decisions. One example of a suitable classifier is a support vector machine (SVM), which, in general, operates by finding a hypersurface in the space of possible inputs, wherein the hypersurface attempts to split triggering criteria from non-triggering criteria. Other directed and undirected model classification approaches include, naive Bayes, Bayesian networks, decision trees, neural networks, fuzzy logic models, and probabilistic classification models providing different patterns of independence, for example. Classification as used herein also is inclusive of statistical regression that is utilized to develop models of priority.

Figure 4:
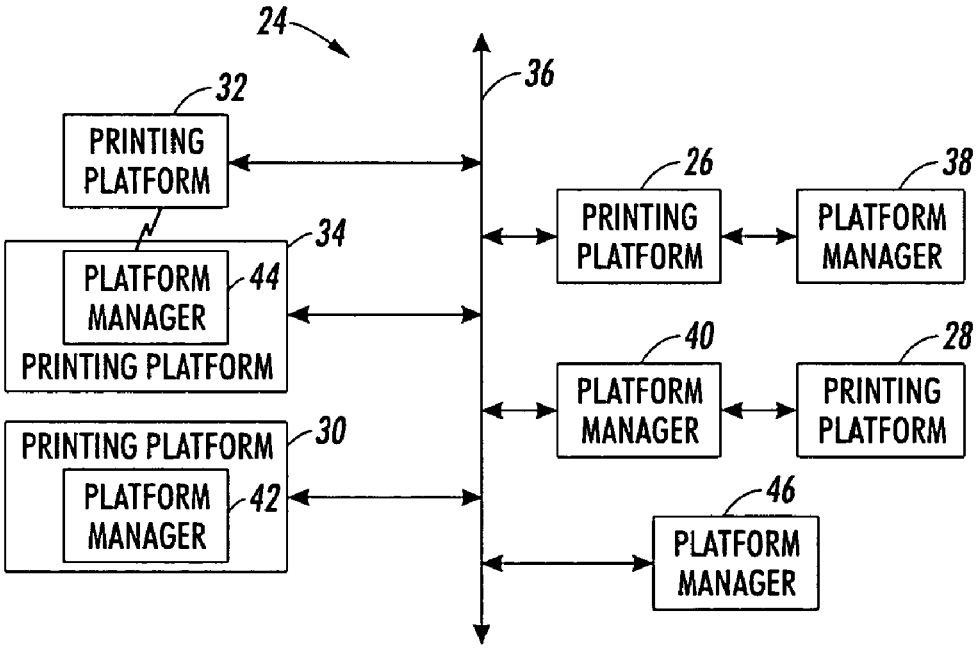
FIG. 4 illustrates a network of printing platforms with variously located platform managers.

With reference to FIG. 4, an exemplary system 24 including a plurality of printing platforms 26, 28, 30, 32 and 34 residing on a network 36 is illustrated. The platforms 26-34 can communicate with each other and other components over the network 36. This example depicts various configurations of the platform managers with respect to the printing platforms 26-34. For example, the printing platform 26 is coupled to the network 36 and an external platform manager 38; the printing platform 28 is coupled to the network 36 through an external platform manager 40; the printing platform 30 is coupled to the network 36 and includes an internal platform manager 42; and the printing platform 34 is coupled to the network 36 through an internal platform manager 44, which it shares with the printing platform 32. It is to be appreciated that these examples are not limitative. For example, each of the printing platforms 26-34 can use any or all of the platform managers 40-46, including a dedicated platform manager 46 residing in the network 36.

Figure 5:
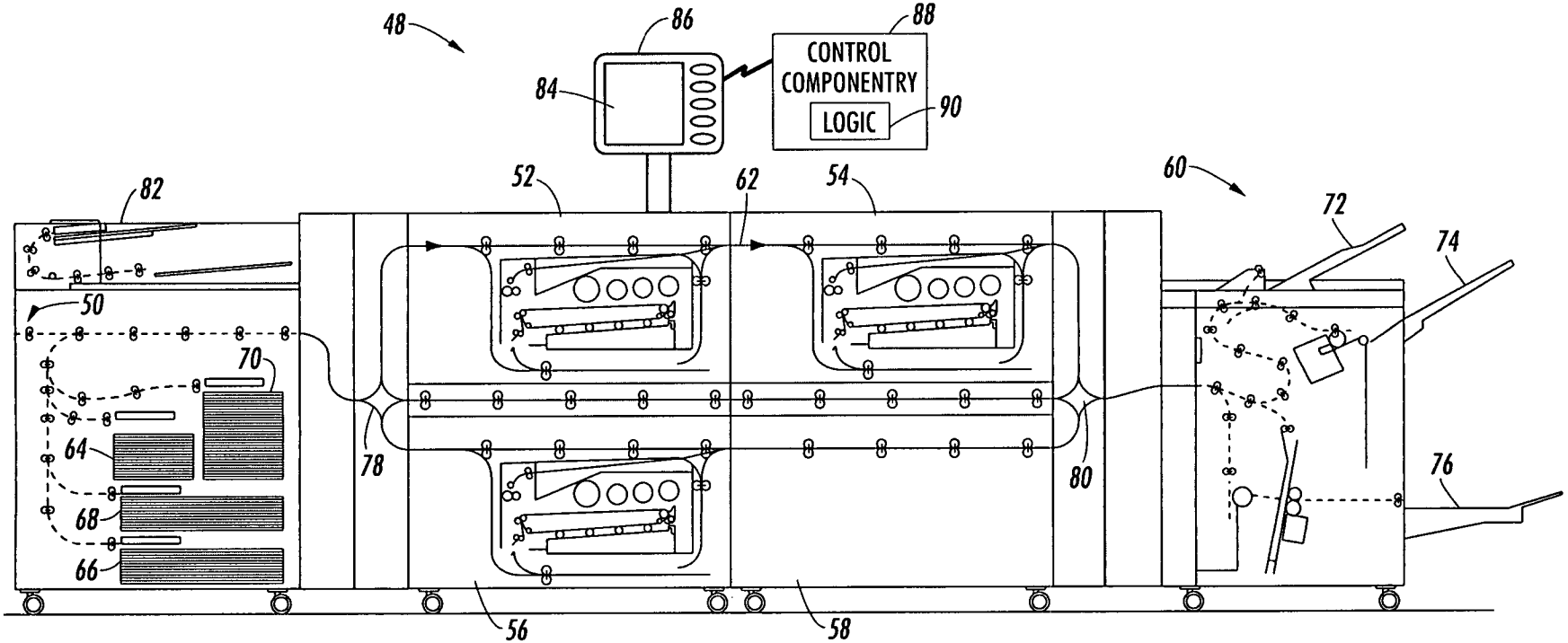
FIG. 5 illustrates an exemplary multi-module printing platform.

With reference to FIG. 5, an "always on" multi module printing platform 48 is illustrated. The platform 48 includes a plurality of units or elements 50, 52, 54, 56, 58 and 60 that are interconnected by a print media conveyor 62. The processing units cooperate to process print jobs at a relatively high rate. While this example illustrates six processing units, it is to be understood that the processing platform can include L processing units, where L is an integer equal to or greater than one. In some instances, one or more of the processing units 50-60 are removable. For example, the functional portion (e.g., marking engine) of the processing unit 58 is shown as removed, leaving only the external housing or mounting fixture through which the print media conveyor 62 passes. In this manner, the functional portion can be removed for repair, or can be replaced to effectuate an upgrade, modification or repair of the platform 48. The platform 48 remains operational with the functional portion of the processing unit 58 is removed, broken, or otherwise unavailable, with some loss of the functionality of the processing unit 48. The processing units 50-60 can be partitioned such that energy can be removed from regions of the printing platform 48 without affecting other regions of the platform 48. Thus, electrical energy, for example, can be removed from the processing unit 58 without affecting the processing units 50-56 and 60. In addition, internal covers can be automatically moved, positioned, and used to isolate the regions from one another, and interlocks can be integrated within the printing system 48 for fail-safe provisions and to mitigate single point failures that can lead to injury to service, the user and/or the printing system 48.

Some or all of the processing units 50-60 may be identical to provide redundancy or improved productivity through parallel printing. Alternatively or additionally, some or all of the processing units 50-60 may be different to provide different capabilities. For example, the processing units 52 and 54 may include color marking engines, while the processing units 56 may include a black (K) marking engine. The processing units 52-58 employ xerographic printing technology, in which an electrostatic image is formed and coated with a toner material, and then transferred and fused to paper or another print medium by application of heat and pressure. However, processing units employing other printing technologies can be provided as processing units, such as processing units employing ink jet transfer, thermal impact printing, or so forth.

The processing unit 50 is a print media source processing unit that supplies paper or other print media for printing, and the processing unit 60 is a finisher that provides finishing capabilities such as collation, stapling, folding, stacking, hole-punching, binding, postage stamping, or so forth. The print media source processing unit 50 includes print media sources 64, 66, 68 and 70 connected with the print media conveyor 62 to provide selected types of print media. While four print media sources are illustrated, K print media sources can be employed, wherein K is an integer equal to or greater than one. Moreover, while the illustrated print media sources 64-70 are embodied as components of the dedicated print media source processing unit 50, in other instances one or more of the marking engines may include its own dedicated print media source instead of or in addition to those of the print media source processing unit 50.

Each of the print media sources 64-70 can store sheets of the same type of print medium, or can store different types of print media. For example, the print media sources 64 and 66 may store the same type of large-size paper sheets, print media source 64 may store company letterhead paper, and the print media source 70 may store letter-size paper. The print media can be substantially any type of medium upon which one or more of the processing units 52-58 can print, such as: high quality bond paper, lower quality "copy" paper, overhead transparency sheets, high gloss paper, and so forth.

The print media conveyor 62 is controllable to acquire sheets of a selected print medium from the print media sources 64-70, transfer each acquired sheet to one or more of the processing units 52-58 to perform selected marking tasks, transfer each sheet to the finisher 60 to perform finishing tasks according to a job description associated with each sheet and according to the capabilities of the finisher.

The finisher unit 60 includes one or more print media destinations 72, 74, and 76. While three destinations are illustrated, the printing platform 48 may include X print media destinations, where X is an integer greater than or equal to one. The finisher unit 60 deposits each sheet after the processing in one of the print media destinations 72-76, which may be trays, pans, or so forth. While only one finisher is illustrated, it is contemplated that two, three, four or more finishers can be employed in the printing platform 48.

The print media conveyor 62 passes through each intermediate processing unit 52-58 to provide a bypass route by which the sheets can pass through the processing unit without interacting therewith. Branch paths are also provided in each processing unit 52-58 to take the sheet off the conveyor 62 and into the functional portion of the processing unit and to deliver the processed sheet back to the conveyor 62. In the processing unit 58, the branch paths are presently removed along with the functional portion; however, the bypass portion of the conveyor 62 remains in the processing unit 58 so as to maintain continuity of the print media conveyor 62. The conveyor 62 may also include other branch junction points such as the example branch junction points 78 and 80 to enable the conveyor to pass sheets along selected paths in the illustrated multiple-path conveyor configuration. This enables the illustrated arrangement in which the marking engine processing units 52-58 are arranged two-dimensionally. In a linear arrangement of processing units (not illustrated), the branch junction points 78 and 80 are suitably omitted.

The printing system 48 executes print jobs. Print job execution involves printing selected text, line graphics, images, machine ink character recognition (MICR) notation, or so forth on front, back, or front and back sides or pages of one or more sheets of paper or other print media. In general, some sheets may be left completely blank. In general, some sheets may have mixed color and black-and-white printing. Execution of the print job may also involve collating the sheets in a certain order. Still further, the print job may include folding, stapling, punching holes into, or otherwise physically manipulating or binding the sheets. The printing, finishing, paper handling, and other processing operations that can be executed by the printing system 48 are determined by the capabilities of the processing units 50-60 of the printing system 48. Those capabilities may increase over time due to addition of new processing units or upgrading of existing processing units. Those capabilities may also decrease over time due to failure or removal of one or more processing units, such as the illustrated removed functional portion of processing unit 58.

Print jobs can be supplied to the printing system 48 in various ways. A built-in optical scanner 82 can be used to scan a document such as book pages, a stack of printed pages, or so forth, to create a digital image of the scanned document that is reproduced by printing operations performed by the printing system 48. Alternatively, a print job can be electronically delivered to a system controller (not shown) via a wire or wireless connection by a remote device such as another print platform, a computer, etc. For example, a network user operating word processing software running on a remote computer may select to print the word processing document on the printing system 48, thus generating a print job, or an external scanner (not shown) connected to the network may provide the print job in electronic form. It is also contemplated to deliver print jobs to the printing system 48 in other ways, such as by using an optical disk reader (not illustrated), or using a dedicated computer connected only to the printing system 48.

An interface 84 provides a mechanism for interaction between the printing system 48 and a user. The interface 84 displays various menus and enables the user to configure the printing system 48 and/or print jobs. The interface 84 is coupled to component 88 that controls the printing system 48. The component 88 can be located within a housing 86 with the interface 84, internally to the printing system 48, or remotely from the printing system 48. In addition, the component 88 can include one or more processors and storage components.

The user interacts with the user interface 84 to navigate through menus, select options, configure the printing platform 4, activate a particular function in connection with a multi-functional platform (e.g., print, copy, scan . . . ), retrieve messages, etc. By way of example, a user desiring to produce several copies of a document can interact with the user interface 84 to activate a copy menu, input a number of copies, define paper type (e.g., letter, A4 . . . ), set paper quality (e.g., resolution) and color (e.g., grey scale, color . . . ), etc. This information is provided to the control component 88, which executes instructions to produce the copies based on the user input. The control component 88 also controls various other aspects of the printing system 48 such as warm up routines, transitions into and out of low power inactivity modes, loading software, firmware and applications, routing print jobs to the processing units 52-58, etc.

The control component 88 includes logic 90 that facilitate selective energizing/de-energizing of regions of the printing system 48. This include can include diagnostics and intelligence that can self diagnose the printing system 48 or facilitate service personnel with diagnosing the printing system 48. For instance, service can perform various diagnostic, troubleshooting, testing, etc. operations on the printing system 48 to interrogate the components (e.g., marking engines, transfer belts, paper highways . . . ) of the printing system 48. Such interrogation can facilitate determining whether any components should be serviced (e.g., corrective and preventative maintenance). The interrogation can include reading data from alpha-numeric and dip switches, registers, memory, etc. The logic 90 analyzes the results of the interrogation and utilizes established protocols (e.g., stored in memory) to determine which components or regions of the printing system 48 to de-energize, the order in which energy should be removed form the components, etc.

The logic 90 can also receive information from sensors positioned within the printing system 48. For example, imaging sensors can be positioned proximate a transfer belt or drum or in connection with a path extending from a marking module. The imaging sensors can be used to collect information indicative of the print quality and provide such information to the logic 90. For instance, the imaging sensors can capture data that can be analyzed to detect streaks, spots, color gamut, glossiness, etc. The logic 90 also analyzes this information to determine components or regions to de-energize.

Upon determining the components, order, etc., the logic removes power (e.g., by transmitting power removal instructions) and energy is removed from the components. The logic 90 can then deactivate menus or alternately and additionally, initiate safeguards, such as for example activating interlocks, positioning internal baffles, etc. associated with the disabled to prevent a user from attempting to employ the de-activated region of the printing system 48. In addition, the logic 88 can display messages (e.g., via the user interface 12) and/or provide audible warnings to apprise the user of the disabled region.

The logic 90 can also perform automated self-diagnostics to discover malfunctions and/or determine the overall health of components of the printing system 48. Component health can be determined through sensing electrical characteristics such as current, voltage, impedance, inductance, capacitance, temperature, etc. Alternately, the component health can be determined through sensing of mechanical, physical, optical, dimensional, or other characteristics, such as, for example; force, pressure, surface gloss, size, and the like. These characteristics typically are specified by a manufacturer or vendor. These can also be specified by the component design engineer, subsystem engineer, system designer and the like. Upon obtaining such characteristics, the logic analyzes them in light of predetermined acceptable values.

The results of the analysis provide an indication of the health of individual components. These characteristics can also be used to generate trends, which may illustrate degradation of a component over time. Such trends can be captured and used during subsequent analyses to determine whether a component is approaching the end of its operational life or is likely to be in the process of failing. This information allows the printing system 48 to request service (and possible corrective maintenance) prior to failure. Such information can also be used to order parts prior to component failure.

The logic 90 optionally uses intelligence, including various machine learning techniques, algorithms, approaches, etc. to facilitate identifying failed components, portions of the printing system 48 to power down, suitable service protocols, etc. For example, a machine learning algorithm can reason about or infer from diagnostics, test results, trends, observations, features, characteristics, and/or properties. In addition, the intelligence can evaluate various run options against knowledge of the upcoming print jobs and therefrom determine how the printing system 48 can continue functioning during service. Upon that determination, limited operability can continue in an automated manner (e.g., by pre-entered default settings) or can communicate status to the user and await further commands. The intelligence can further analyze the information to determine whether remaining portions of the printing platform 4 can continue to operate safely.

The control component 88 can provide the interrogation results, the analysis of the results, and/or associated information to other entities. For instance, such data can be conveyed to a central command center where it is used to order parts, adjust inventory, notify a service technician to re-stock the part at the customer location, etc. In another example, the data can be provided to a database and used for historical purposes, evaluating the cost and downtime, generating statistics, etc.

The printing system 48 is an illustrative example. In general, any number of print media sources, media handlers, marking engines, collators, finishers or other processing units can be connected together by a suitable print media conveyor configuration. While the printing system 48 illustrates a 2×2 configuration of four marking engine processing units 52-58, buttressed by the media source unit 50 on one end and by the finisher unit 60 on the other end, other physical layouts can be used, such as an entirely horizontal arrangement, stacking of processing units three or more units high, or so forth. Moreover, while in the printing system 48 the marking engine processing units 52-58 have removable functional portions, in some other embodiments some or all processing units may have non-removable functional portions and/or field replaceable units. It will be appreciated that even if the functional portion is non-removable, the provision of the print media conveyor 62 with bypass paths through each intermediate processing unit enables the processing unit to be taken "off-line" for repair or modification while the remaining processing units of the printing system continue to function as usual.

In some embodiments, separate bypasses for intermediate components may be omitted. The "bypass path" of the conveyor in such configurations suitably passes through the functional portion of a processing unit, and optional bypassing of the processing unit is effectuated by conveying the sheet through the functional portion without performing any processing operations. Still further, in some embodiments the printing system may be a cluster of networked or otherwise logically interconnected printers each having its own associated print media source and finishing components.

The plurality of processing units 50-60 and flexible print media conveyor 62 enables the printing system 48 to have a large number of capabilities and features. Each marking engine 52-56, for example, has associated low-level print settings such as xerographic voltages, fuser temperatures, toner reproduction curves, and so forth. Some of these low-level print settings are optionally modified depending upon the sequence along which a given sheet passes through the printing system 48; for example, it may be advantageous to modify the fusing temperatures of serially performed xerographic processes. At a higher functional level, each marking engine has associated functional parameters such as contrast, resolution, and so forth.

The user generally is not directly concerned about low-level print settings, or even about higher functional level parameters. Rather, the user has certain user preferences regarding performance of the printing system 48. The user ideally wants a highly efficient or productive printing (that is, a high throughput of sheets and print jobs through the printing system 48), high printing quality, image quality consistency across each print job, and so forth. At the same time, the user ideally wants the printing system 48 to maintain high reliability (that is, minimize the down-time of the printing system 48), low run cost (achieved, for example, by minimizing cycling of processing units between idle and active states), low service costs (achieved, for example, by distributing usage of consumable elements across similar processing units), high energy efficiency, and so forth.

It will be appreciated that these user preferences are interrelated and generally not simultaneously fully attainable. As an example, the highest image quality may require use of large quantities of toner, whereas to minimize service costs the marking engines should use as little toner as possible. Thus, a trade-off is required between image quality and service costs. High productivity leans toward marking sheets in parallel by simultaneously running several marking engines; however, image quality consistency militates toward using only one or two marking engines having similar color characteristics. Similar tradeoffs are typically required between various others of the user preferences.

It will be appreciated that variations of the above-disclosed and other features and functions, or alternatives thereof, may be desirably combined into many other different systems or applications. Various and variant embodiments presently unforeseen or unanticipated alternatives, modifications, variations or improvements therein may be subsequently made by those skilled in the art which are also intended to be encompassed by the following claims.

The claims can encompass embodiments in hardware, software, or a combination thereof.

The term "printer," "print," and variations thereof as used herein encompass any apparatus, such as a digital copier, bookmaking machine, facsimile machine, multi-function machine, etc. which performs a print outputting function for any purpose.

The invention claimed is:

1. A printing platform, comprising:

a source that provides a print media substrate;

one or more marking modules and associated components energizable for operation by at least one of electrical, mechanical, pneumatic, light, air flow and vacuum power for reproducing an image on the print media substrate;

a finisher that finishes the image print media substrate; and a platform manager for selectively identifying a failed or service-needing one of marking modules and associated components and for automatically removing at least one of electrical, mechanical, pneumatic, light, air flow and vacuum power from marking module and associated components of the printing platform while other marking modules and associated components continue to process print jobs, wherein the marking module and associated components having removed power are functionally and physically removable, while the printing platform remains operational.

2. The printing platform of claim 1, wherein the platform manager receives user input about the marking modules and associated components of the printing platform, analyzes the input, and determines which marking module and associated components to de-energize based on the input.

3. The printing platform system of claim 1, wherein the platform manager compares marking module and associated component test results input by service personnel against established service protocols to determine which marking module and associated components to de-energize and an order in which to de-energize the marking module and associated components.

4. The printing platform of claim 1, wherein the platform manager re-routes print jobs associated with the marking module and associated components identified for power removal to ensure the print jobs are processed.

5. The printing platform of claim 1, further including a diagnostic component that self-diagnoses the marking modules and associated components of the printing platform and determines which marking module and associated components to de-energize.

6. The printing platform of claim 5, the diagnostic component determines at least one of whether any marking module and associated component require corrective maintenance, whether any marking module and associated component require preventive maintenance, and the overall health of respective components.

7. The printing platform of claim 6, the health of each marking module and associated component are determined through sensed operational characteristics, including at least one of current, voltage, impedance, inductance, capacitance, temperature, mass, force, pressure, surface gloss, reflectivity, and size.

8. The printing platform of claim 7, the sensed electrical, mechanical, optical, and/or physical characteristics are analyzed against predetermined acceptable operating values.

9. The printing platform of claim 5, the diagnostic component senses print quality characteristics from one or more imaging sensors located proximate to at least one of a transfer belt, a drum, a fuser, and a substrate output path.

10. The printing platform of claim 9, the image sensors capture information analyzed to detect at least one of streaks, spots, color gamut, image density, and glossiness.

11. The printing platform of claim 1, further including an intelligent component that employs various machine learning techniques to facilitate identifying failed marking module and associated components, determining which portions of the printing platform to power down, and at least one of selecting, identifying, and displaying suitable service protocols to employ to analyze marking module and associated component test results.

12. The printing platform of claim 11, wherein the intelligent component evaluates different run options against knowledge of an upcoming print job to determine how the printing platform will continue functioning when regions of the printing platform are de-energized.

13. The printing platform of claim 1, wherein the marking module and associated components of the printing platform are partitioned such that regions of components that execute in conjunction to process a print job are concurrently de-energized.

14. The printing platform of claim 1, wherein the platform manager transmits analysis results and information associated with de-energized marking module and associated components to a central command center to at least one of order a part, adjust inventory, and notify a service technician.

15. The printing platform of claim 1, further including one or more interlocks associated with at least one of an external or an internal cover that removes electrical power to a region of components when the interlock is activated to mitigate injury to at least one of service personnel, the user, and a component of the printing platform.

16. The printing platform of claim 1, wherein the one or more marking modules are stacked one of vertically, horizontally, and vertically and horizontally to form one of a tandem, a parallel and a cluster printer.

17. The printing platform of claim 1, wherein the one or more marking modules include one or more of an electrophotographic printer, an ink-jet printer, a solid ink printer, and a thermal head printer.

18. The printing platform of claim 1, wherein the one or more marking modules respectively include one or more black (K), custom color (C), process color (P), and magnetic ink character recognition (MICR) (M) marking engines.

19. A xerographic process for selectively de-energizing one or more marking modules and associated components of a printing platform while other marking modules and associated components of the printing platform process print jobs, so that the de-energized marking modules and associated components are functionally and physically removable while the platform remains operational, comprising:

receiving input indicative of operating characteristics of one or more marking module and associated components of the printing platform;

evaluating the input with respect to pre-defined service protocols;

identifying regions of marking module and associated components to de-energize based on the service protocols; and de-energizing the marking module and associated components.

20. A method for self-diagnosing and automatically removing power from one or more marking modules and associated components of a printing platform, comprising:

executing diagnostics within the printing platform;

using the diagnostics to interrogate one or more marking modules and associated components of the printing platform;

analyzing the results of the interrogation;

identifying marking module and associated components to de-energize;

determining an order in which to de-energize the marking module and associated components; and de-energizing and physically removing the identified marking module and associated components while other marking modules and associated components remain operational and process print jobs.

* * * * *